United States Patent [19]

Cheung et al.

[11] 3,953,643

[45] Apr. 27, 1976

[54] METHOD FOR COATING AND PRODUCT

[75] Inventors: Mo-Fung Cheung, Warren; Ray A. Dickie, Birmingham, both of Mich.

[73] Assignee: Ford Motor Company, Dearborn, Mich.

[22] Filed: Dec. 20, 1974

[21] Appl. No.: 534,926

[52] U.S. Cl. ..... 428/220; 260/29.4 UA; 260/851; 427/379; 427/388; 427/407; 427/409; 428/463; 428/520; 526/16

[51] Int. Cl.[2] ..... B05D 1/38; B05D 7/14; B05D 7/24

[58] Field of Search ..... 427/409, 407, 388, 379; 260/80.75, 851, 29.4 UA; 428/463, 520, 220

[56] References Cited

UNITED STATES PATENTS

| | | | |
|---|---|---|---|
| 2,760,886 | 8/1956 | Prentiss et al. | 427/409 X |
| 2,952,564 | 9/1960 | Traverso | 427/409 X |
| 3,107,227 | 10/1963 | Suen et al. | 260/858 X |
| 3,218,280 | 11/1965 | Koral et al. | 260/856 X |
| 3,245,932 | 4/1966 | Glavis et al. | 260/851 X |
| 3,821,145 | 6/1974 | Walus | 260/851 X |
| 3,850,734 | 11/1974 | Parekh et al. | 427/409 X |

*Primary Examiner*—Ralph Husack
*Attorney, Agent, or Firm*—Olin B. Johnson; Keith L. Zerschling

[57] ABSTRACT

A method for painting automobiles and other articles of manufacture which admits of the use of medium to high concentration of metal pigments, can provide high gloss finish coatings and employs a low concentration of volatile solvents comprising application of a relatively thin, highly pigmented, water-based coating to a substrate, air drying or optionally, heat curing, application of an unpigmented or lightly pigmented water-based coating that is transparent on curing, and heat curing of the powder coating.

Products bearing unique finish coatings prepared by this method are claimed.

This invention relates to the art of coating. More specifically this invention relates to a novel method of coating substrates, particularly metal substrates, and to the products produced by such method.

12 Claims, No Drawings

METHOD FOR COATING AND PRODUCT

BACKGROUND OF THE INVENTION

Much of the research and development effort in the metal coating art is directed to the search for coating materials and methods of applying such materials which eliminate or approach elimination of volatile, organic solvents released in heat curing, which produce coatings at least comparable to conventional paints and methods of painting in appearance and durability, and which can be produced at a commercially feasible cost.

One proposal before the art is to replace liquid coating material with coating materials in the form of so-called water-based coatings, i.e., aqueous resin solutions and aqueous resin emulsions. Conventionally, these contain a concentration of volatile organic solvents that is far below that in conventional liquid enamels and lacquers, i.e., resin solutions and resin dispersions or both in an organic solvent, but significantly higher than is found in powder coatings. Other problems encountered with water-based coatings include (1) problems of humidity control (2) problems of film fracture during the bake known as "popping", occur in areas receiving an unnecessarily thick coating, often the result of substrate contours, and (3) problems in obtaining finish coatings having a high gloss without special care and cost in formulation.

Another approach to providing quality coatings in a low emission system has been the use of the so called "powder paints." These conventionally contain very low concentrations of volatile solvents, i.e., substantially less than any other paint system and of the order of 2& or slightly higher, and, in this regard, have much to recommend them. Inherent in their use, however, are certain problems of production and application which have retarded the extent of their adoption. One of these involves their use in conjunction with particulate metal pigments, ordinarily aluminum flakes. Automobiles coated with a so-called "metallic" finish, i.e., a topcoat of enamel or lacquer in which there is dispersed aluminum flakes in addition to conventional pigments, have found wide acceptance in the marketplace. For the most part, the problems incidental to employing aluminum flakes in conventional liquid paints, i.e., problems of paint manufacture and paint application, have been solved through years of experimentation and use. The problems of using aluminum flakes in dry powder are far more complex, particularly where some type of pulverizing step is a part of the paint manufacturing process and when application of the paint to a substrate is by electrostatic spray techniques. Further, while increased use of powder coatings in greater volume and improved methods of manufacture will reduce the present cost of quality powder coatings, their production in all of the colors demanded in the marketplace may be prohibitive.

One approach to resolution of these problems involves the application of a highly pigmented, metal-flake containing water-based enamel base coat, which is subsequently baked and then topcoated with a clear powder coating. While this process has many advantages and produces an excellent surface finish, it necessitates handling two different paint systems each of which require quite different application and handling processes and equipment.

THE INVENTION

The invention hereinafter described in detail provides a method of painting characterized by low solvent emissions, a capacity for producing coatings of high gloss while maintaining other requisite properties, and the production of substrates having unique qualities particularly suitable for variations in styling.

One object of this invention is to provide a method of coating wherein the organic solvent concentration of coating materials is greatly reduced while providing a high quality, high gloss finish at an acceptable cost.

Another object of this invention is to provide a method for employing metal pigments and water-based coating materials in producing a finish coating which avoids the need for employing two radically different coating facilities in finishing operations and the problems inherent in handling and applying powder paints on the one hand and which, on the other, reduces the complexity and expense of humidity control in the application of metallic water-based enamels.

Another object of this invention is to provide a method of coating wherein water-based paints may be employed with minimal humidity control, film-popping, or special formulation to obtain high gloss.

Another object of this invention is to provide coated substrates having unique properties.

While this invention is also effective for painting polymeric substrates under the same conditions hereinafter set forth for painting metal with due allowance for the maximum temperature tolerance of the substrate, this invention is primarily directed to the painting of metal.

The metal substrate to be used will ordinarily be steel which has received conventional preparations for finish coating, i.e., cleaning, phosphate treating and coating with a conventional primer paint to provide corrosion protection and enhance adhesion of the finish coat.

In the method of this invention, a substrate is provided with a protective and decorative finish coat in a series of essential steps.

In the first step of this method, the substrate is coated with a relatively thin, highly pigmented, water-based thermosetting enamel to an average film thickness between about 0.4 and about 1.5, preferably 0.5 to 1.0, mils (1 mil = 0.001 inch). The enamel will contain beween about 6 and about 60 weight percent of combined pigments based on resin solids, i.e., about 6 to about 60 parts by weight particulate pigment to about 40 to about 94 parts by weight of film-forming material, the latter consisting essentially of thermosetting polymer conventionally called "paint binder resins" and crosslinking agents where such resins are not self-crosslinking. The variance will depend upon the type of metallic or "nonmetallic" finish desired, i.e., and concentration and type of pigments used.

In the second step, the thin, pigmented, water-based coating is allowed to dry at least partially. The coating may be heat cured by baking at a metal temperature in the range of about 200°, to 350°, preferably 225° to 275°F. for a time in the range of about 5 to about 15 minutes. Conditions as stringent as these need only be employed when high humidity is encountered in the spray area. If the humidity does not exceed about 65% relative humidity at a temperature of at least about 25°C., the drying of the first coat may consist of about 1 to about 15 minutes, at ambient spray booth conditions.

In the third step, there is applied to the thin, pigmented, water-based coating a second water-based coating of average film thickness between about 0.4 and 1.8 mils, which upon baking provides an essentially transparent overcoat. Ordinarily, the overcoat is pigment-free but in some embodiments, appearance is enhanced by the inclusion of small amounts of very small pigments which do not negative its transparency, e.g., transparent iron oxides.

In the fourth step, the transparent overcoat and the underlying water-based coating are baked at an average temperature in the range of about 250° to about 350°F., preferably in the range of 265° to 340°F., for a time in the range of about 15 to about 30 minutes.

It will be understood by those skilled in the art that in each of the baking steps, the time of baking is preferably inversely proportional to the temperature of the same within the ranges specified therefor. It will further be understood by those skilled in the art that in each of the baking steps, it may be advantageous to employ an oven not uniform in temperature, but graded or zoned in temperature from a relatively low value to a relatively high one from the entrance to the exit of said oven.

The water-based coating materials may be applied by electrostatic, air or hydraulic spray, or a combination of electrostatic and air or hydraulic spray. The water-based coating used as the transparent overcoat may be any water-based material providing substantial transparency when baked; of necessity it must adhere well to the basecoat and should have good flow or leveling properties and good film-build characteristics.

The method of this invention has advantages relative to conventional processes employing a single water-based coating material and also relative to a similar process employing a water-based pigmented undercoat identical to that of the present invention in combination with a powder coating overcoat.

Relative to the single material water-based coating systems, the method of this invention provides the following advantages:

1. improved styling capability. Coatings obtained by the method of this invention have unique qualities that admit of a wider range of styling variations in automobiles and other articles of manufacture where color effect is an important factor in market acceptance. Surprisingly, coatings can be prepared by this method which demonstrate value change at an unusually low angle of incidence. Otherwise stated, the rate of change of color value, i.e., change from light to dark and vice versa, with respect to the angle of light impingement is greater than with conventional automobile finish coats and greater than with either water-based coatings or powder coatings. Further, the segregation of the aluminum flakes in the basecoat admits of the use of coarser pigments, e.g., larger aluminum particles, without pigment protrusions from the completed coating. This provides additional flexibility for achieving desired polychromatic effects. This flexibility is further enhanced through the employment of small amounts of the aforementioned transparent pigments which, in effect, tint the transparent overcoat.
2. less sensitivity to sagging and popping. This results from application of the topcoat in two stages with an intermediate drying or baking step.

3. less stringent humidity control. This also results from application of the topcoat in two stages with an intermediate drying or baking step. Further, application of the metal-containing layer as a very thin coat allows better control of metallic effect over a broader range of humidity than does the use of a coating of full depth in a single material water-based system.
4. reduced solvent emission. One of the principle functions of organic solvents in water-based coatings is to provide improved film build characteristics; application via a two stage process with an intermediate bake allows reduction in the amount of solvent used.
5. reduced usage of components in short supply. Solvents used in water-based coatings, e.g., diethylene glycol monobutyl ether, are in relatively short supply. Usage of these materials can be reduced by application of the present process.
6. improved appearance. The position of pigments in the basecoat gives an appearance of depth not obtainable with single-material process.
7. improved "fill" properties. This relates to the capability of a coating material to obliterate substrate irregularities, e.g., metal scratches, etc. High pigment loadings are conducive to hiding such irregularities but in a single coat system a compromise must be struck between achieving such hiding and obtaining a coating with good gloss. The one works against the other. The need for such a compromise is eliminated here with a heavily pigmented basecoat to provide "hiding" and a transparent overcoat to provide gloss.
8. less application problems and increased mottle resistance. This is particularly true where metal pigments are employed. It is less difficult to obtain a good particle orientation in a thin, highly pigmented, water-based coating than it is with a water-based coating of full depth. A mottled appearance in metallic finishes ordinarily results from poor aluminum flake orientation.
9. improved chemical resistance. The overcoat can be free of pigment and any easily attacked chemical linkages and provides excellent chemical resistance for paints.

Relative to coatings employing a water-based undercoat with a transparent powder overcoat, the present invention provides the following advantages:

1. greater process simplicity. Only one basic type of coating material is involved; there is no need for expensive powder handling or application equipment.
2. greater ease of manufacture. Again, the use of one basic type of material eliminates the need for additional specialized equipment for production of powder.
3. greater process flexibility. Topcoat application equipment is conventional and can be used for two-tone or repair operations, or for final coat application in a conventional single-material process.
4. shorter line distance in ovens. Water-based paints generally require shorter baking times and lower baking temperatures than powder coatings. Further, the first stage bake is optional in this process, but is required where a powder overcoat is used.
5. shorter process times. When the optional first stage oven bake is replaced by air drying, there is no need to allow the car body to cool before application of the topcoat.

6. simplified formulation. Production of high gloss single-material high metallic water-based enamels requires the use of special polymer latexes and crosslinking agents. The basecoat need not be glossy, simplifying formulation problems and reducing cost.

Any water-based thermosetting paint which can be used in automobile topcoats and is curable under the time-temperature conditions hereinbefore set forth, may be used as the basecoat in the method of this invention.

The water-based enamels preferred for use in this invention are disclosed in U.S. patent application Ser. No. 476,114 filed June 3, 1974, now U.S. Pat. No. 3,919,154, for Yun-Feng Chang et al. The disclosures of this application are incorporated herein by reference.

The hybrid-water-based paint compositions preferred for use in this invention employ in combination a low molecular weight emulsion polymer and a low molecular weight solution polymer with the latter being present in an amount sufficient to contribute significantly to the composition of the polymeric binder, i.e., at least about 5 weight percent of this polymer combination. Thus, they differ from the conventional emulsion type paints employing a water-soluble thickener polymer in at least three compositional respects irrespective of chemical functionality, namely (1) the emulsion polymers have significantly lower molecular weights, (2) the solution polymers have significantly lower molecular weights, and (3) the solution polymers are employed in significantly higher concentrations than are the water-soluble thickener polymers.

More specifically, the hybrid paint compositions of this invention, exclusive of optional components such as pigments, particulate fillers and catalysts, have a liquid continuous aqueous phase. About 30 to about 50% by weight of this phase, exclusive of the aforecited optional components, is made up of a mixture of (*a*) an amino resin crosslinking agent; (*b*) a mixture of at least two copolymers of acrylic monomers; and (*c*) an amine. The balance is water or, in certain embodiments, water and an organic solvent. The mixture of copolymers comprises (*i*) about 5 to about 95, preferably about 5 to about 50, and most preferably about 10 to about 30, parts by weight of a "solution polymer", i.e., a carboxy-functional copolymer of acrylic monomers that (i) is at least partially neutralized with an amine, (ii) is soluble in said aqueous phase, (iii) has average molecular weight ($\overline{M}_n$) in the range of about 3,000 to about 20,000 and (iv) has Tg in the range of −15° to 50°C., and (2) about 5 to about 95, preferably about 50 to about 95 and most preferably about 50 to about 70 parts by weight of an "emulsion polymer", i.e., a copolymer of acrylic monomers having carboxy, hydroxy or carboxy and hydroxy functionality that (i) is essentially insoluble in said continuous phase, (ii) has average molecular weight ($\overline{M}_n$) in the range of about 3,000 to about 20,000 and (iii) has Tg of −15° to 50°C. The amino resin crosslinking agent is present in an amount in the range of about 15 to about 35 weight percent of the sum of the weight of solution polymer and the weight of emulsion polymer. The amine is a water-soluble amine and is present in an amount sufficient to solubilize the solution polymer in the aqueous phase at a pH range of about 7.1 to about 8.5. In certain embodiments, hereinafter illustrated, these hybrid compositions include organic cosolvents while in other embodiments such solvents are not present.

When applied to the substrate to be coated by spraying, these water-based paints including pigments, particulate fillers, and catalysts, if any, contain between about 50 and about 65% by weight water or in those embodiments wherein such solvents are used, water and organic cosolvents.

PREPARATION OF WATER-BASED PAINT

A number of methods can be used to prepare the water-based paints preferred for use in this invention.

In a first general method, at least one of the polymers, usually the solution polymer, is polymerized in solution in a water miscible or dilutable organic solvent while the other polymer, usually the emulsion polymer, is prepared by an emulsion polymerization in water. The resultant water-based paint will contain a conventional, essentially non-reactive, water-miscible or dilutable organic paint solvent. The concentration of organic solvent in such paints will be at least about 5% by volume of the volatile phase, i.e., organic solvent and water, and preferably in the range of about 10 to about 20 volume percent of the volatile phase.

In a second general method both the solution polymer and the emulsion polymer are prepared by emulsion polymerization in water. The paints thus prepared are prepared without organic solvents and thus employed free of same. Organic solvents in the amounts used in the first general method may be added to the dispersion, if desired.

A third general method is the same as the first general method except for the difference that in carrying out the emulsion polymerization the surfactant, i.e., surface active agent or emulsifier, is replaced by a solution polymer hereinafter more fully described.

A fourth general method is the same as the second general method except for the difference that in carrying out one or both, preferably both, of the emulsion polymerizations the surfactant is replaced by a solution polymer hereinafter more fully described.

The advantage provided by the third and fourth general methods is that elimination of the conventional surfactant eliminates the problem of incompatibility and water sensitivity associated with the use of surfactants.

POLYMER COMPOSITION WATER-BASED PAINTS

A. The solution polymer in these paints has carboxy functionality and may also have hydroxy functionality and/or amide functionality. These polymers contain about 5 to about 30 mole percent of acrylic or methacrylic acid and 70 to 95 mole percent of olefinically unsaturated monomers copolymerizable with such acid component. Preferably, these other olefinically unsaturated monomers are monoacrylates or monomethacrylates. In the embodiment wherein the primary solution polymer has only carboxy functionality, these are preferably esters of acrylic acid or methacrylic acid and a $C_1$–$C_8$ monohydric alcohol. $C_8$–$C_{12}$ monovinyl hydrocarbons such as styrene, alpha methyl styrene, t-butyl styrene, and vinyl toluene may comprise up to about 30 mole percent of such polymer. Vinyl monomers such as vinyl chloride, acrylonitrile, methacrylonitrile and vinyl acetate may be included in the copolymer as modifying monomers. However, when employed, these modifying monomers should constitute only between about 0 and about 30, preferably 0 to about 15, mole percent of such polymer. In the embodiment wherein the solution polymer has both carboxy functionality and hydroxy functionality, the copolymer contains about 5 to about 25 mole percent of acrylic or methacrylic acid, about 5 to about 25 mole percent of a hydroxyalkylacrylate or methacrylate, e.g., hydroxyethyl acrylate, hydroxypropyl acrylate, hydroxyethyl methacrylate or hydroxypropyl methacrylate, and a remainder of the same monofunctional monomers as set forth above for the solely carboxy-functional polymer. In still another embodiment, the polymer has amide functionality in addition to carboxy functionality. Such a polymer contains about 5 to about 25 mole percent acrylic acid or methacrylic acid, about 5 to about 25 mole percent of acrylamide, methacrylamide, N-methylolacrylamide, N-methylolmethacrylamide, or the alkyl ether of a methylolacrylamide or a methylolmethacrylamide, e.g., N-isobutoxymethylolacrylamide, with the remainder of the same monofunctional monomers as set forth above for the solely carboxy-functional polymer. A portion of the amide functional monomers may be replaced with an equimolar amount of one of the aforementioned hydroxyacrylates or hydroxymethacrylates.

Other monomers not heretofore mentioned may be used in these polymers if used in limited concentrations. These include 2-acrylamide-2-methylpropanesulfonic acid and methacryloyloxyethylphosphate, which may comprise up to about 3% of such polymer.

B. The emulsion polymer in these paints has carboxy functionality, hydroxy functionality or carboxy and hydroxy functionality. These polymers contain 0 to 15 mole percent acrylic acid or methacrylic acid, preferably 0 to 10 mole percent, and 85 to 100 mole percent of other olefinically unsaturated monomers that are copolymerizable with each other and with the acid component when the latter is used. Such other olefinically unsaturated monomers are the same in type and of the same percentage distribution range as those heretofore disclosed for the solution polymer with the exception of the acid monomers content above noted.

In those embodiments, wherein both the solution polymer and the emulsion polymer have hydroxy functionality and carboxy functionality, it is preferred to have a greater concentration of carboxy functionality on the solution polymer relative to the emulsion polymer and a greater concentration of the hydroxy functionality on the emulsion polymer relative to the solution polymer.

Thus, the combinations involved include (*a*) a carboxy-functional solution polymer and a hydroxy-functional emulsion polymer, (*b*) a carboxy-functional solution polymer and a carboxy-functional emulsion polymer, (*c*) a carboxy-functional solution polymer and a carboxy-functional, hydroxy-functional emulsion polymer, (*d*) a carboxy-functional and hydroxy-functional solution polymer and a hydroxy-functional emulsion polymer, (*e*) a carboxy-functional, hydroxy-functional solution polymer and a carboxy-functional and hydroxy-functional emulsion polymer, (*f*) a carboxy-functional and amide-functional solution polymer and a hydroxy-functional emulsion polymer, (*g*) a carboxy-functional and amide-functional solution polymer and a carboxy-functional emulsion polymer, (*h*) a carboxy-functional and amide-functional solution polymer and a carboxy-functional and hydroxy-functional emulsion polymer, (*i*) a carboxy-functional, hydroxy-functional, and amide-functional solution polymer and a hydroxy-functional emulsion polymer, (*j*) a carboxy-functional, hydroxy-functional, amide-functional solution polymer and a carboxy-functional emulsion polymer, and (*k*) a carboxy-functional, hydroxy-functional, amide-functional solution polymer and a carboxy-functional, hydroxy-functional emulsion polymer. Amide functionality may also be incorporated into the emulsion polymer but this is more difficult to achieve efficiently than in the solution polymer, particularly in the case of modified amide functionality, e.g., N-methylolacrylamide.

C. The amino resin crosslinking agent, may be and is hereafter illustrated as a conventional amino resin crosslinking agent of the type long in use as a crosslinking agent in acrylic enamels, e.g., melamine-formaldehyde resins and urea-formaldehyde resins.

DETAILED DESCRIPTION OF FIRST GENERAL METHOD FOR PREPARING WATER-BASED PAINTS DESCRIBED HEREIN

A. Preparation of Solution Copolymer

In preparing the water-soluble copolymer, the functional monomers and the remaining monoethylenically unsaturated monomers are mixed and reacted by conventional free radical initiated polymerization in such proportions as to obtain the copolymer desired. A large number of free radical initiators are known to the art and are suitable for this purpose. These include benzoyl peroxide; t-butyl peroctoate; t-butyl perbenzoate; lauryl peroxide; t-butyl-hydroxy peroxide; acetylcyclohexane sulfonyl peroxide; diisobutyryl peroxide; di-(2-ethylhexyl) peroxydicarbonate; diisopropyl peroxydicarbonate; t-butylperoxypivalate; decanoyl peroxide; axobis(2-methyl propionitrile); etc. The polymerization is carried out in solution using a solvent which is miscible or dilutable with water. The solvent concentration at this stage is ordinarily about 30 to 60 weight percent of the polymerization solution. The polymerization is carried out at a temperature between about 45°C. and the reflux temperature of the reaction mixture. Included among the suitable solvents are n-propyl alcohol, isopropyl alcohol, dioxane, ethylene glycol monomethyl ether, ethylene glycol monoethyl ether, ethylene glycol monobutyl ether, diethylene glycol monobutyl ether, diethylene glycol monomethyl ether acetate, diethylene glycol monoethyl ether, diethylene glycol monobutyl ether, ethylene glycol monomethyl ether acetate, diethylene glycol monoethyl ether acetate, etc. The copolymer thus obtained is neutralized with amine to a pH of about 6 to 10 and diluted to desired viscosity with water or organic solvent.

B. Preparation of Emulsion Copolymer

In preparing the emulsion copolymer, the functional monomers are mixed and reacted by conventional free-radical initiated polymerization in aqueous emulsion to obtain the copolymer desired.

Conventional surfactants, chain transfer agents, and initiators are employed in the emulsion polymerization. The monomer charge is usually emulsified by one or more micelleforming compounds composed of a hydrophobic part, such as a hydrocarbon group containing six or more carbon atoms, and a hydrophilic part, such as hydroxyl groups, alkali metal, ammonium carboxylate groups, sulfonate groups, phosphate or sulfate partial ester groups, or a polyether chain. Exemplary emulsifying agents include alkali metal sulfonates of styrene, naphthalene, decyl benzene, and dodecyl benzene; sodium dodecyl sulfate; sodium stearate; sodium oleate; the sodium alkyl aryl polyether sulfates and phosphates; the ethylene oxide condensates of long chain fatty acids, alcohols, and mercaptans, and the alkali metal salts of rosin acids. These materials and the techniques of their employment in emulsion As will be disclosed later herein, the solution polymer may also be prepared by emulsion polymerization. In such preparation, the resultant acid-functional copolymer latex is converted to a polymer solution by the addition of an appropriate base, usually ammonia or an organic amine. There are, however, different needs involved in the after-preparation employment of the emulsion polymer that is used as such in formulation of paint and the solution polymer which although prepared by emulsion polymerization is subsequently converted to a solution polymer and used as such. These needs should be taken into consideration in the preparation procedure.

In the use of emulsion polymerization to produce a solution polymer, there is no need for the resulting latex to be stable under conditions different from those ensuing at the end of the polymerization process since the latex no longer exists, as such, after the polymer goes into solution upon neutralization. To facilitate such conversion to solution polymers, polymers prepared by emulsion polymerization for use as solution polymers ordinarily contain a higher concentration of carboxyl groups and a lower concentration of decidedly hydrophobic monomers, e.g., 2-ethylhexyl acrylate, relative to the corresponding concentrations in the polymers prepared by emulsion polymerization for use as such.

In contrast, latices which are used as such in the formulation of paint are required to remain essentially as stable latices throughout the processes of polymerization, paint formulation, and product distribution and use. This implies a requirement of stability, i.e., freedom from coagulum formation through time and under a variety of pH conditions, solvent environment, etc. These requirements are best met, and hence it is preferred to use, an alkali metal or ammonium persulfate either as the sole polymerization initiator, or as one constituent of a mixed initiator system. In those embodiments in which conventional surfactants, more specifically a combination of anionic and nonionic surfactants, to obtain a more stable latex. Such surfactant mixtures are well known in the art.

C. Formulation of Paint

The polymer solution and the polymer latex prepared according to the aforedescribed procedures are subsequently converted into a paint using conventional paint formulation techniques. Typically, a mill base is prepared which comprises the bulk of the pigment and/or particulate filler of the paint formulation. The mill base is "let down" i.e., blended with the remaining polymeric and liquid constituents of the final formulation. A mill base, prepared by conventional sand grinding, ball milling, or pebble milling generally comprises all or a part of the water soluble resin, pigments, organic cosolvents, and may also comprise a quantity of amine in excess of that required to solubilize the solution polymer. To complete the paint, the polymer latex which has been neutralized to a pH range of 5.0 to 10, preferably 5 to 9, is added with mild agitation to the balance of the water required in the total formulation. The balance of the watersoluble resin, crosslinking agent, and millbase are added slowly with agitation. Additional quantities of pigment may be added subsequently as slurries in organic solvents or as separate mill bases to adjust the color as desired. The viscosity of the finished paint is determined and adjusted as required to obtain desired application properties.

Alternately, all or a portion of the (preferably neutralized) polymer latex, water, organic cosolvent, and amine may be added to the solution polymer and pigments prior to ball milling, sand grinding, or pebble milling. This procedure is advantageously employed to reduce the viscosity of mill bases prepared using the solution polymers of relatively high molecular weight.

The water-based paints used as transparent overcoats in the process of this invention are formulated in the same way as the pigmented basecoats, save only for the emission of pigments or substantial reduction in the quantity thereof.

D. Use of Organic Amines

Organic amines are used to neutralize carboxyl groups on the solution polymer and hence to render it soluble in the aqueous dispersion. They are also used to maintain the pH of the finished paint formulation above about 7, e.g., in the range of 7–10, preferably between 7 and 9.5, and with certain pigments such as aluminum flakes preferably between 7 and 9, to prevent premature reaction of the functional groups on the acrylic copolymer with the amino resin crosslinking agent. Those skilled in the art will be aware that in certain embodiments the paint dispersion can be made up at a pH outside the pH range for application and later adjusted to the desired pH shortly before it is applied. A portion of the amine, e.g., preferably between about 60 and 100% of the amount chemically equivalent to the carboxyl functionality of the polymer is added to the solution polymer directly. Advantageously, a small additional portion of amine is used to raise the pH of the emulsion polymer to about 5 to about 10, preferably 5 to 9, prior to finishing the paint formulation so that the mill base is not subjected to the low pH environment of the polymer latex (pH about 2.5).

Suitable amines are amines (1) which are soluble in the aqueous medium of the paint, (2) that ionize sufficiently in such aqueous medium to solubilize the solution polymer, (3) that ionize sufficiently in such aqueous medium when employed in suitable amounts to provide the paint dispersion with a pH of at least about 7, preferably 7.2 or higher, and thereby keep the rate of reaction between reactive groups of the amino resin (crosslinking agent) negligible prior to curing and (4) that allow for rapid curing of the enamel upon heating. Suitable amines include alkyl, alkanol and aryl primary, secondary and tertiary amines. Preferred are secondary and tertiaryalkyl and alkanol amines having a boiling point within the range of 80°–200°C. By way of example, these include N,N-dimethyl ethanolamine, N,N-diethylethanolamine, isopropanolamine, morpholine, N-methylmorpholine, N-ethylmorpholine, N-methylethanolamine, 2,6-dimethylmorpholine, methoxypropylamine, and 2-amino-2-methyl-1-propanol.

E. Catalysts

Catalysts for the curing of resins described herein are not normally required to obtain satisfactory film properties. If desired, however, for purposes of lowering the film baking temperature or of further improving cured film properties, strong acid catalysts can be employed in an amount not in excess of 3% by weight of the total finished paint formulation. Said strong acid catalysts may be introduced either as copolymerizable species incorporated in one or both acrylic copolymers, e.g., 2-acrylamide-2-methylpropanesulfonic acid, or as a non-polymerizable additive, e.g., p-toluenesulfonic acid. It is generally preferred not to add such catalysts, however, as they may tend to increase the water sensitivity of the cured film and may deleteriously affect storage stability of the liquid paint.

F. Cosolvents

In those embodiments wherein a volatile organic solvent is employed as a cosolvent, i.e., solution of the solution polymer also being affected by the use of a water-soluble amine, the following solvents are suitable for this use include: n-propyl alcohol, isopropyl alcohol, butanol, 2-butoxyethanol, 2(2-butoxy)ethoxyethanol, n-oxtyl alcohol, dioxane, ethylene glycol monomethyl ether, ethylene glycol monoethyl ether, ethylene glycol monobutyl ether, diethylene glycol monomethyl ether, diethylene glycol monoethyl ether, diethylene glycol monoethyl ether, diethylene glycol monobutyl ether, ethylene glycol monomethyl ether acetate, diethylene glycol monoethyl ether acetate, etc.

DETAILED DESCRIPTION OF SECOND GENERAL METHOD FOR PREPARING WATER-BASED PAINTS DESCRIBED HEREIN

A. Preparation of Solution Polymer

In this method, the water-soluble copolymer is produced by emulsion polymerization. The functional monomers are mixed and reacted by conventional free-radical initiated polymerization in aqueous emulsion to obtain the copolymer desired. The resulting acid-functional copolymer latex is converted to a polymer solution by the addition of an appropriate base, usually ammonia or an organic amine.

Conventional surfactants, chain transfer agents, and initiators are employed in the emulsion polymerization. The monomer charge is usually emulsified by one or more micelleforming compounds composed of a hydrophobic part, such as a hydrocarbon group containing six or more carbon atoms, and a hydrophilic part, such as hydroxyl group, alkali metal or ammonium carboxylate groups, phosphate or sulfate partial ester groups, sulfonate groups, or a polyether chain. Exemplary emulsifying agents include alkali metal sulfonates or styrene, naphthalene, decyl benzene and dodecyl benzene; sodium dodecyl sulfate; sodium stearate; sodium oleate, the sodium alkyl aryl polyether or sulfates and phosphates; the ethylene oxide condensates of long chain fatty acids, alcohols, and mercaptans, and the alkali metal salts of rosin acids. These materials and the techniques of their employment in emulsion formation and maintenance. As previously pointed out, however, when emulsion polymerization is used to product a solution polymer, there is no need for the resulting latex to be stable under conditions different from those ensuing at the end of the polymerization process since the latex no longer exists as such after the polymer goes into solution upon neutralization. To facilitate such conversion to solution polymers, polymers prepared by emulsion polymerization for use as a solution polymer ordinarily contain a higher concentration of carboxyl groups and a lower concentration of decidedly hydrophilic monomers, e.g., 2-ethylhexyl acrylate, relative tc the corresponding concentrations in the polymers prepared for use as emulsion polymers. Further, the teaching hereinbefore set forth with respect to the choice of initiators when preparing the latter, i.e., using an alkali metal or ammonium persulfate either as the sole polymerization initiator or as one constitutent of a mixed initiator system to avoid coagulum formation through time and under a variety of pH conditions, solvent environment, etc., is applicable where the polymer is to be converted to a solution polymer. Such initiators may be used when preparing the solution polymer by emulsion polymerization but conventional peroxide initiators are quite suitable for this. Hence, this method offers an advantage, in this respect, in that the concentration of ionic inorganic contaminants, e.g., sulfate ions, in the paint formulation is reduced. A chain transfer agent or mixture of chain transfer agents may be added to the reaction medium to limit the molecular weight of the polymer, such chain transfer agents are generally mercaptans such as dodecanethiol, benzenethiol, 1-octanethiol, pentanethiol and butanethiol. These are conventional materials employed in a conventional manner. The polymerization initiator is composed of one or more water-soluble, free-radical-generating species such as hydrogen peroxide or the sodium, potassium or ammonium persulfates, perborates, peracetates, percarbonates and the like. As is well known in the art, these initiators may be associated with activating systems such as redox system which may incorporate mild reducing agents, such as sulfites and thiosulfites and redox reaction promoters such as transition metal ions. As hereinbefore mentioned, however, it is desirable to maintain a low concentration of non-polymeric ionic species in the finished paint formulation in order that the cured paint film may have optimum resistance to water. Hence, it is preferred to use a minimum concentration of such optional inorganic salts as ferrous sulfate, sodium bisulfite, and the like. Those skilled in the art will be aware that other emulsifying agents, polymerization initiators and chain transfer agents may be used which are compatible with the polymerization system herein required and with the attainment of acceptable cured paint film properties.

B. Preparation of Emulsion Copolymer

The emulsion copolymer may be prepared using the same procedures hereinbefore recited for preparation of the emulsion copolymer in part B. of the first general method.

C. Formulation of Paint

The polymer solution and the polymer latex prepared according to the aforedescribed procedures may be subsequently converted into a paint using the same procedures hereinbefore recited for formulation of paint in part C. of the first general method.

D. Use of Organic Amines

The use of organic amines and amines which are suitable for such use are the same for this general method as hereinbefore described in detail in part D. of the first general method.

E. Catalysts

The use of catalysts and catalysts which are suitable for curing the resins hereinbefore described and hereinafter illustrated are the same for this general method as hereinbefore described in detail in part D. of the first general method.

F. Cosolvents

The use and choice of cosolvents for use with this general method may be the same as hereinbefore described in part F. of the first general method.

DETAILED DESCRIPTION OF THIRD GENERAL METHOD FOR PREPARING WATER-BASED PAINTS DESCRIBED HEREIN

The third general method for preparing the paints disclosed herein is identical with the first general method hereinbefore described in detail except for the difference that all or a part of the surfactant, i.e., surface active agent or emulsifier, employed in preparing the emulsion polymer, is replaced with a stabilizer polymer, that is identical with or similar to, the solution polymer heretofore described in the first and second general methods and employed as a primary constituent of the paints described herein.

The stabilizer polymer of the third and fourth general methods is carboxy functional and soluble in the aqueous phase of these paint dispersions and is either the same as the primary solution polymer, heretofore discussed, or similar to such solution polymer and compatible with the system. The average molecular weight ($\overline{M}_n$) of the stabilizer polymer may be the same as that of the primary solution polymer, i.e., between 3,000 and 20,000 but advisedly is of lower molecular weight than the primary solution polymer. Preferably, the average molecular weight of this third copolymer is in the range of about 3,000 to about 8,000. Its Tg is in the range of −15° to 50°C. When the stabilizer polymer is used in lieu of the surfactant to prepare either the solution polymer or the emulsion polymer, it is present in a concentration in the range of about 0.2 to about 10, preferably about 0.5 to about 5, weight percent based on the weight of polymer to be prepared.

The stabilizer polymer may be prepared by any of several methods, including (1) the method used to prepare the solution polymer of the first general method of paint preparation, i.e., polymerization in solution in a water miscible or dilutable organic solvent; (2) the method used to prepare the solution polymer for the second general method of paint preparation, i.e., emulsion polymerication using an emulsifier or surfactant; (3) emulsion polymerization using in lieu of a surfactant a small amount of the intended polymer from a previous preparation; and (4) a method of emulsion polymerization described hereinafter which employs neither surfactant nor a water soluble polymer in lieu thereof. In the latter, conventional chain transfer agents and polymerization initiators are used as described hereinbefore for the preparation of a solution polymer by emulsion polymerization. A mixture of monomers including carboxyfunctional monomers and a chain transfer agent is added slowly to a stirred mixture of initiator and water maintained at a suitable reaction temperature, e.g., between 45° and 95°C. It is preferred to add simultaneously with the monomer mixture an additional quantity of polymerization initiator to sustain a sufficient initiator concentration throughout the polymerization. The polymer latex so obtained is filtered and neutralized with ammonia or water-soluble amine to render it water soluble.

DETAILED DESCRIPTION OF FOURTH GENERAL METHOD FOR PREPARING PAINTS DESCRIBED HEREIN

The fourth general method for preparing the paints disclosed herein is identical with the second general method hereinbefore described in detail except for the difference that all or a part of the surfactant used to prepare the solution polymer, the emulsion polymer or, preferable, both the solution polymer and the emulsion polymer is replaced by a stabilizer polymer, such as heretofore described in detail in the description of the third general method.

The term "vinyl monomer" as used herein means a monomeric compound having in its molecular structure the functional group

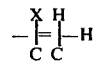

wherein X is a hydrogen atom or a methyl group.

The term "copolymer" as used herein means a polymer formed from two or more different monomers.

"Alpha-beta unsaturation" as used herein includes both the olefinic unsaturation that is between two carbon atoms which are in the alpha and beta positions relative to an activating group such as a carboxyl group, e.g., the olefinic unsaturation of maleic anhydride, and the olefinic unsaturation between the two carbon atoms which are in the alpha and beta positions with respect to the terminus of an aliphatic carbon-to-carbon chain, e.g., the olefinic unsaturation of acrylic acid, methyl methacrylate or styrene.

This invention will be more fully understood from the following illustrative examples:

EXAMPLE 1

An automobile body which, after passing through a seven-stage phosphate treatment to surface condition the metal, has been prime and guide coated to an average depth of about 1.5 mils is finish coated in accordance with the method of this invention.

In this instance, the prime coat is a pigmented, polycarboxylic acid resin paint which electrodeposited upon the metal substrate to an average depth of about 0.8 mil in accordance with the method of U.S. Pat. No. 3,230,162 to Allan E. Gilchrist. After the prime coat has been baked to cure, there is applied over the prime coat a guide coat pigmented to a color quite different from the prime coat. In this instance, the guide coat is a conventional epoxy ester thermoset paint, i.e., a di- or poly-epoxide (Bishenol A — Epichlorohydrin type) which has been reacted with soya fatty acids and mixed as a major fraction with a minor fraction of a melamineformaldehyde resin which serves as a cross-linking agent. This guide coat is applied by spraying to an average depth of about 0.7 mil. The guide coat is baked to cure and sanded. It is then ready for the finish coat.

PREPARATION OF COMPONENTS OF FINISH COATING

A. Preparation of Polymers for the Water-Based Coating Material

1. The Emulsion Polymer (Acrylic Copolymer Latex)

| Monomers and Additives | Parts by Weight |
|---|---|
| styrene | 360 |
| butyl methacrylate | 600 |
| hydroxypropyl methacrylate | 216 |
| acrylic acid | 24 |
| n-octyl mercaptan | 7 |
| ammonium persulfate | 6.9 |
| dimethyl ethanol amine | 6 |
| Triton X-200[1] | 44 |
| Triton X-305[2] | 52 |

[1]a product of Rohm and Haas Company, characterized as an anionic surfactant containing 28% active component described as the sodium salt of an alkyl aryl polyether sulfonate.
[2]a product of Rohm & Haas Company, characterized as a nonionic surfactant containing 70% active component described as an alkyl aryl polyether alcohol averaging 30 ethylene oxide units per molecule.

Procedure

To a flask equipped with a water condenser, agitator and thermometer are charged 770 parts by weight deionized water, 1.9 parts by weight ammonium persulfate and 22 parts by weight of Triton X-200. This charge is then heated to 95°C.

An aqueous emulsion of acrylic monomers is formed by mixing the styrene, butyl methacrylate, propyl methacrylate, and acrylic acid with the n-octyl mercaptan, 52 parts by weight Triton X-305, 22 parts by weight of Triton X-200, 648 parts by weight of deionized water and 5 parts by weight of ammonium persulfate.

The emulsion of acrylic monomers is added dropwise to the heated charge over a three-hour period during which the charge is maintained at 95°C. The reaction mixture is held under continued agitation for 2 hours at 95°C. after addition of the monomers is complete. The reaction mixture is then allowed to cool to 35°C. When the temperature of the reaction mixture reaches 35°C., there is added a mixture of the dimethyl ethanol amine and 49 parts by weight deionized water. The resulting product is a stable, milky white liquid dispersion with a nonvolatile content of 44–45%, a viscosity of 50 centipoise, and a pH of 5.

2. The Solution Polymer (water soluble acrylic copolymer)

| Monomers and Additives | Parts by Weight |
|---|---|
| butyl methacrylate | 555 |
| 2-ethylhexyl acrylate | 300 |
| styrene | 375 |
| hydroxypropyl methacrylate | 150 |
| acrylic acid | 120 |
| diethylene glycol monobutyl ether | 611 |
| dimethylethanol amine | 111 |
| t-butyl perbenzoate | 48 |

Procedure

Into a flask equipped with a water condenser, agitator and thermometer is charged 488 parts by weight of diethylene glycol monobutyl ether and this is heated to 150° to 155°C. The styrene, butyl methacrylate, 2-ethylhexyl acrylate, hydroxypropyl methacrylate, acrylic acid, 45 parts by weight 5-butyl perbenzoate and 110 parts by weight of ethylene glycol monobutyl ether are mixed and added dropwise to the flask over a three-hour period while the temperature of the reaction mixture is maintained at 150°–155°C. The reaction mixture is continuously agitated for 1 hour after monomer addition is complete. At the end of this hour, there are added three parts by weight of t-butyl perbenzoate and 13 parts by weight of diethylene glycol monobutyl ether. The reaction mixture is maintained until agitation and at a temperature of 150° to 155°C. for 1 hour. It is then allowed to cool to 100°C. at which time 111 parts by weight of dimethylethanol amine and 389 parts by weight of deionized water are added to the flask. The resulting product is a clear amber polymeric material with a nonvolatile content of 60% and a G-H Bubble Viscosity of 2–5 to 2–6.

B. Preparation of the Water-based Coating Material

A "silver" colored, metal-pigmented, basecoat is prepared by mixing the following materials in the order of listing under continuous agitation:

| Ingredients | Parts by Weight |
|---|---|
| acrylic copolymer, latex (emulsion polymer of "A") | 43.1 |
| acrylic copolymer, solution (solution polymer of "B") | 21.1 |
| melamine resin (hexakismethoxymethylmelamine) | 10.5 |
| aluminum paste[1] (fine flake) | 4.8 |
| carbon black pigment dispersion[2] | trace |
| blue pigment dispersion[3] | trace |
| diethylene glycol monobutyl ether | 2.3 |
| deionized water | 18.2 |

[1]60% solids aluminum paste in mineral spirits.
[2]a mixture prepared by ball billing the following materials in the parts by weight indicated: diethylene glycol monobutyl ether 20, deionized water 49, carbon black pigment 10, hexakismethoxymethylmelamine 20, and dimethyl ethanol amine 1.0.

[3]a mixture prepared by ball milling the following materials in the parts by weight indicated: blue pigment 10, diethylene glycol monobutyl ether 30, deionized water 30, and acrylic polymer solution 30.0.

This water-based material has a total solids content of about 45% and the pigment concentration by weight is about 6.4% based on the weight of solids.

A transparent water-based overcoating material is prepared according to the same procedure, and using the same ingredients as specified for the metal-pigmented basecoat save only that the aluminum paste, carbon black pigment dispersion, and blue pigment dispersion are omitted from the formulation.

C. Painting the Substrate

A basecoat of the water-based coating material of C is diluted with deionized water to a spraying viscosity of 25 seconds number 4 Ford Cup and applied to the substrate to an average depth of about 0.8 mil by electrostatic spray. This basecoat is heat cured by baking at 225°F. (metal temperature) for 10 minutes.

After the substrate has cooled to room temperature, the transparent overcoating material from C is applied over the basecoat to an average thickness of about 1.0 mils. This coating is heat cured using a 20 minute bake cycle at temperatures moving upward from 175°F. to 325°F. (metal temperature) and remaining at 325°F. for about 10 minutes.

The resultant layered coating is smooth. It exhibits exceptionally high gloss and the appearance of having unusual depth.

EXAMPLE 2

The procedure of Example 1 is repeated except for the difference that the pigmented water-based basecoating material is prepared from the following materials:

| Ingredients | Parts by Weight |
|---|---|
| acrylic copolymer, latex (emulsion polymer of "A" of Example 1) | 35.2 |
| acrylic copolymer, solution (solution polymer of "B" of Example 1) | 1.8 |
| melamine resin (hexakismethoxymethylmelamine) | 8.3 |
| blue pigment dispersion (from "C" of Example 1) | 51.1 |
| titanium dioxide pigment dispersion[1] | 1.0 |
| carbon black pigment dispersion (from "C" of Example 1) | 1.3 |
| aluminum paste (coarse flake) | 1.3 |

[1]a mixture prepared by blending the following materials in the parts by weight indicated: acrylic copolymer-solution (from "B" of Example 1) 22.9, diethylene glycol monobutyl ether 11.0, titanium dioxide pigment 55.0 and deionized water 11.1.

This dark blue water-based material has a total solids content of about 41% and the total pigment concentration by weight is about 16% based on the weight of solids. As in the preceding example, this material is diluted to spraying viscosity prior to application to a substrate.

The resultant layered coating is smooth. It exhibits exceptionally high gloss and the appearance of having unusual depth.

EXAMPLE 3

The procedure of Example 1 is repeated except for the difference that the pigmented water-based basecoating material is prepared from the following materials:

| Ingredients | Parts by Weight |
|---|---|
| acrylic copolymer, latex (emulsion polymer of "A" of Example 1) | 18.8 |
| acrylic polymer, solution[1] (solution polymer of "B" of Example 1) | — |
| melamine resin (hexakismethoxymethylmelamine) | 5.6 |
| titanium dioxide pigment dispersion (from Example 2) | 59.8 |
| carbon black pigment dispersion (from "C" of Example 1) | trace |
| deionized water | 15.8 |

[1]Component is contained in titanium dioxide pigment dispersion.

This white water-based material has a total solids content of about 55% and the total pigment concentration is about 60% based on weight of solids. As in the preceding examples, this material is diluted to a spraying viscosity prior to application to a substrate.

The resultant layered coating is smooth. It exhibits exceptionally high gloss and has the appearance of having unusual depth.

EXAMPLE 4

The procedure of Example 1 is repeated except for the difference that the water-based coating material is prepared from the following materials:

| Ingredients | Parts by Weight |
|---|---|
| acrylic copolymer, latex (emulsion polymer of "A" (from Example 1) | 32.7 |
| acrylic copolymer, solution (solution polymer of "B" | |

-continued

| Ingredients | Parts by Weight |
|---|---|
| from Example 1) | 9.4 |
| melamine resin (hexakismethoxymethylmelamine | 8.0 |
| blue pigment dispersion (from "C" of Example 1) | 12.8 |
| titanium dioxide pigment dispersion (from Example 2) | 12.2 |
| carbon black pigment dispersion (from "C" of Example 1) | trace |
| deionized water | 24.9 |

This pastel blue, water-based material has a total solids content of about 40% and the total pigment concentration is about 20% based on weight of solids. As in the preceding examples, this material is diluted to a spraying viscosity prior to application to a substrate.

The resultant layered coating is smooth. It exhibits exceptionally high gloss and has the appearance of having unusual depth.

EXAMPLE 5

The procedures of Examples 1–4 are repeated with the sole difference that the basecoat is allowed to air dry for 2 minutes at ambient spray booth conditions of 55% relative humidity, 27°C. prior to application of the topcoat. Equivalent results are obtained.

EXAMPLE 6

A "silver" colored, metal-pigmented basecoat and clear coat are prepared by mixing the following materials in the order of listing and description herein set forth.

| | Ingredients | Parts by Weight |
|---|---|---|
| I. | acrylic copolymer latex (emulsion polymer of "A" of Example 1) | 333 |
| | acrylic copolymer, solution (solution polymer of "B" of Example 1) | 120 |
| | melamines resin (Resimene 740)[1] | 84 |
| | deionized water | 93 |
| II. | green pigment dispersion[2] | 16.2 |
| | aluminum paste[3] (medium size flake) | 8 |
| | diethylene glycol monobutylether | 16 |

[1]a product of Monsanto Company, characterized as a 90% solution of methylated melamine resin in isopropanol.
[2]a mixture prepared by ball milling the following materials in the parts by weight indicated: green pigment 10, acrylic polymer solution 18, diethylene glycol monobutyl ether 36, dimethyl ethanol amine 1.0, deionized water 35.
[3]60% solids aluminum paste in mineral spirits.

Ingredients in (I) are added in order of listing under continuous agitation. 210 parts of (I) are taken out and reserved as clear coat.

To the remaining portion is added 16.2 parts of green pigment dispersion, 8 parts of aluminum paste together with 16 parts of diethylene glycol monobutylether after such additional materials have been mixed with agitation to form a slurry.

This silver green water-based coating has a total solids content of about 45% and the pigment concentration is about 3.2.

The application procedures are the same as described in Example 1. Furthermore, the resultant layered coatings can be achieved with or without the intermediate baking cycle. The coating exhibits exception ally high gloss and the appearance of having unusual depth.

EXAMPLE 7

The procedures of Example 6 are repeated with the sole difference that 24.3 parts of green pigment dispersion is added to the first step (I), i.e., it forms a green transparent material. Equivalent results are obtained with similar application procedures. This method of incorporating pigment dispersion is believed to be unique especially when extra hiding power is needed as parts with excessive character lines are encountered.

The term "acrylic monomer" as used herein means a compound selected from the group consisting of glycidyl acrylate, glycidyl methacrylate, acrylic acid, hydroxyethyl acrylate, hydroxypropyl acrylate, hyroxyethyl methacrylate, hydroxypropyl methacrylate, esters of acrylic acid and a $C_1$–$C_8$ monohydric alcohol, and esters of methacrylic acid and a $C_1$–$C_8$ monohydric alcohol.

The term acrylic copolymer means a copolymer of monoethylenically unsaturated compounds at least a major portion of which are acrylic monomers.

The term "major portion" means in excess of 50 weight percent of the entity referred to.

Many modifications of the foregoing examples will be apparent to those skilled in the art in view of this specification. It is intended that all such modifications which fall within the scope of this invention as defined in the claims shall be considered to be a part of this invention.

Any and all disclosures appearing in the claims and not specifically appearing in the same words in the body of this specification are herewith incorporated in the body of this specification by reference.

We claim:

1. In a method for coating a substrate with diverse layers of coating material which comprises applying a heat-curable first coating material to said substrate, applying a second coating material over said first coating material, after a time in excess of one minute, and heating said substrate, the improvement wherein:

I. said first coating material is applied to said substrate as a dispersion of solids in an aqueous solution of a water-soluble amine and consists essentially of about 6 to about 60 parts by weight particulate pigment and about 40 to about 94 parts by weight of thermosetting paint binder which consists essentially of A. 100 parts by weight acrylic paint binder resins consisting essentially of 1. about 5 to about 95 parts by weight of a solution polymer which is a carboxy-functional acrylic copolymer that
   a. is at least partially neutralized with said aqueous solution of water-soluble amine,
   b. is soluble in said aqueous solution,
   c. has average molecular weight ($\overline{M}_n$) in the range of about 3,000 to about 20,000 and
   d. has Tg in the range of -15°C. to 50°C., and
2. about 5 to about 95 parts by weight of an emulsion polymer having functionality selected from carboxy functionality and hydroxy functionality and is an acrylic copolymer that
   a. is essentially insoluble in said aqueous solution,
   b. has average molecular weight ($\overline{M}_n$) in the range of about 3,000 to about 20,000 and
   c. has Tg in the range of −15°C. to 50°C., and B. about 15 to about 35 parts by weight of an amino resin crosslinking agent for said solution polymer and said emulsion polymer, II. said first coating material is applied to said substrate to an average thickness in the range of about 0.4 to about 1.2 mils, and III. said second coating material is applied to said substrate as a dispersion of solids in an aqueous solution of a water-soluble amine and consists essentially of thermosetting paint binder which consists essentially of A. 100 parts by weight acrylic paint binder resins consisting essentially of 1. about 5 to about 50 parts by weight of a solution polymer which is a carboxy-functional acrylic copolymer that
   a. is at least partially neutralized with said aqueous solution of watersoluble amine,
   b. is soluble in said aqueous solution,
   c. has average molecular weight ($\overline{M}_n$) in the range of about 3,000 to about 20,000 and
   d. has Tg in the range of -15°C. to 50°C., and
2. about 50 to about 95 parts by weight of an emulsion polymer having functionality selected from carboxy functionality and hydroxy functionality and is an acrylic copolymer that
   a. is essentially insoluble in said aqueous solution,
   b. has average molecular weight ($\overline{M}_n$) in the range of about 3,000 to about 20,000 and
   c. has Tg in the range of −15°C. to 50°C., and B. about 15 to about 35 parts by weight of an amino resin crosslinking agent for said solution polymer and said emulsion polymer, IV. said second coating material is applied to said substrate over said first coating material to an average thickness in the range of about 0.4 to about 1.8 mils, and V. said second coating material is heated by maintaining said substrate at a temperature in the range of about 250°F. to about 350°F. for a time in the range of about 15 to about 30 minutes.

2. A method in accordance with claim 1 wherein about 50 to 65 weight percent of said dispersion of solids in an aqueous solution of water-soluble amine is water and said dispersion has a pH between 7 and 10.

3. A method in accordance with claim 2 wherein an equal volume of an essentially non-ionizable organic solvent for said solution resin is substituted for about 5 to about 20 volume percent of said water and said first coating material is applied to said substrate to an average thickness in the range of about 0.5 to 1.0 mil.

4. A method in accordance with claim 3 wherein said organic solvent is an alcohol.

5. A method in accordance with claim 1 wherein in addition to said solution polymer and said emulsion polymer, said dispersion of solids contains a stabilizer polymer which is a carboxy-functional acrylic copolymer that is soluble in said aqueous solution, has average molecular weight ($M_n$) in the range of about 3,000 to about 8,000 and below that of said solution polymer and is present in said dispersion of solids in an amount in the range of 0.2 to about 10 weight percent of said emulsion polymer.

6. A method in accordance with claim 1 wherein said second coating material is applied to said substrate to an average thickness in the range of 1.0 to 1.5 mils.

7. In a method for coating a substrate with diverse layers of coating material which comprises applying a heatcurable first coating material to said substrate, heating said substrate to at least partially cure said first coating material, applying a second coating material over said first coating material, after heating said first coating material for a time in excess of about 5 minutes, and heating said substrate for a second time, the improvement wherein:

I. said first coating material is applied to said substrate as a dispersion of solids in an aqueous solution of a water-soluble amine and consists of about 6 to about 60 parts by weight particulate pigment and about 40 to about 94 parts by weight of thermosetting paint binder which consists essentially of A. 100 parts by weight paint binder resins consisting essentially of 1. about 5 to about 50 parts by weight of a solution polymer which is a carboxy-functional copolymer of acrylic monomers that a. is at least partially neutralized with said aqueous solution of water-soluble amine, b. is soluble in said aqueous solution, c. has average molecular weight ($\overline{M}_n$) in the range of about 3,000 to about 20,000 and d. has Tg in the range of −15°C. to 50°C., and 2. about 50 to about 95 parts by weight of an emulsion polymer having functionality and hydroxy functionality and is a copolymer of acrylic monomers that a. is essentially insoluble in said aqueous solution, b. has average molecular weight ($\overline{M}_n$) in the range of about 3,000 to about 20,000, and c. has Tg in the range of −15°C. to 50°c., and B. about 15 to about 35 parts by weight of an amino resin crosslinking agent for said solution polymer and said emulsion polymer, II. said first coating material is applied to said substrate to an average thickness in the range of about 0.4 to about 1.2 mils, III. said first coating material is heated after application to said substrate and prior to application of second coating material to said substrate by maintaining said substrate at a temperature in the range of about 200°F. to about 350°F. for a time in the range of about 5 to about 15 minutes, and IV. said second coating material is applied to said substrate as a dispersion of solids in an aqueous solution of a water-soluble amine and consists essentially of thermosetting paint binder which consists essentially of A. 100 parts by weight acrylic paint binder resins consisting essentially of 1. about 5 to about 50 parts by weight of a solution polymer which is a carboxy-functional acrylic copolymer that a. is at least partially neutralized with said aqueous solution of water-soluble amine, b. is soluble in said aqueous solution, c. has average molecular weight ($\overline{M}_n$) in the range of about 3,000 to about 20,000 and d. has Tg in the range of −15°C. to 50°C., and 2. about 50 to about 95 parts by weight of an emulsion polymer having functionality selected from carboxy functionality and hydroxy functionality and is an acrylic copolymer that a. is essentially insoluble in said aqueous solution, b. has average molecular weight ($\overline{M}_n$) in the range of about 3,000 to about 20,000 and c. has Tg in the range of −15°C. to 50°C., and B. about 15 to about 35 parts by weight of an amino resin crosslinking agent for said solution polymer and said emulsion polymer, V. said second coating material is applied to said substrate over said first coating material to an average thickness in the range of about 0.4 to about 1.8 mils, and VI. said second coating material is heated by maintaining said substrate at a temperature in the range of about 250°F. to about 350°F. for a time in the range of about 15 to about 30 minutes.

8. A method in accordance with claim 7 wherein about 50 to about 65 weight percent of said dispersion of solids in an aqueous solution of water-soluble amine is water and said disprsion has a pH between 7 and 10.

9. A method in accordance with claim 8 wherein an equal volume of an essentially non-ionizable organic solvent for said solution resin is substituted for about 5 to about 20 volume percent of said water and said first coating material is applied to said substrate to an average thickness in the range of about 0.5 to about 1.0 mil.

10. A method in accordance with claim 9 wherein said organic solvent is an alcohol.

11. A method in accordance with claim 7 wherein said second coating material is applied to said substrate to an average thickness in the range of 1.0 to 1.5 mils.

12. An article of manufacture comprising a substrate, a pigmented layer of a first coating material adhered to said substrate and a transparent layer of a second coating material opposite said substrate wherein:

I. said first coating material is applied to said substrate as a dispersion of solids in an aqueous solution of a water-soluble amine and consists essentially of about 6 to about 60 parts by weight particulate pigment and about 40 to about 94 parts by weight of thermosetting paint binder which consists essentially of A. 100 parts by weight paint binder resins consisting essentially of 1. about 5 to about 50 parts by weight of a solution polymer which is a carboxy-functional acrylic copolymer that a. is at least partially neutralized with said aqueous solution of water-soluble amine, b. is soluble in said aqueous solution, c. has average molecular weight ($\overline{M}_n$) in the range of about 3,000 to about 20,000 and d. has Tg in the range of −15°C. to 50°C., and 2. about 5 to about 95 parts by weight of an emulsion polymer having functionality selected from carboxy functionality and hydroxy functionality and is an acrylic copolymer that a. is essentially insoluble in said aqueous solution, b. has average molecular weight ($\overline{M}_n$) in the range of about 3,000 to about 20,000, and c. has Tg in the range of −15°C. to 50°C., and B. about 15 to about 35 parts by weight of an amino resin crosslinking agent for said solution polymer and said emulsion polymer, II. said first coating material is applied to said substrate to an average thickness in the range of about 0.4 to about 1.2 mils, III. said first coating material is heated after application to said substrate and prior to application of said second coating material to said substrate by maintaining said substrate at a temperature in the range of about 200°F. to about 350°F. for a time in the range of about 5 to about 15 minutes, and IV. said second coating material is applied to said substrate as a dispersion of solids in an aqueous solution of a water-soluble amine and consists esentially of thermosetting paint binder which consists essentially of A. 100 parts by weight acrylic paint binder resins consisting essentially of 1. about 5 to about 50 parts by weight of a solution polymer which is a carboxy-functional acrylic copolymer that a. is at least partially neutralized with said aqueous solution of water-soluble amine, b. is soluble in said aqueous solution, c. has average molecular weight ($\overline{M}_n$) in the range of about 3,000 to about 20,000 and d. has Tg in the range of −15°C. to 50°C., and 2. about 50 to about 95 parts by weight of an emulsion polymer having functionality selected from carboxy functionality and hydroxy functionality and is an acrylic copolymer that a. is essentially insoluble in said aqueous solution, b. has average molecular weight ($\overline{M}_n$) in the range of about 3,000 to about 20,000 and c. has Tg in the range of −15°C. to 50°C., and B. about 15 to about 35 parts by weight of an amino resin crosslinking agent for said solution polymer and said emulsion polymer, V. said second coating material is applied to said substrate over said first coating material to an average thickness in the range of about 0.4 to about 1.8 mils, and VI. said second coating material is heated by maintaining said substrate at a temperature in the range of about 250°F. to about 350°F. for a time in the range of about 15 to about 30 minutes.

* * * * *